United States Patent [19]

Flohr

[11] Patent Number: 4,700,739

[45] Date of Patent: Oct. 20, 1987

[54] PNEUMATIC WELL CASING PRESSURE REGULATING SYSTEM

[75] Inventor: Mark C. Flohr, Irvine, Calif.

[73] Assignee: Smith International, Inc., Newport Beach, Calif.

[21] Appl. No.: 798,634

[22] Filed: Nov. 14, 1985

[51] Int. Cl.[4] ..... E21B 34/08

[52] U.S. Cl. ..... 137/488; 137/624.15; 175/25

[58] Field of Search ..... 137/487.5, 485, 624.13, 137/624.14, 624.15, 488; 175/25

[56] References Cited

U.S. PATENT DOCUMENTS 4,481,768 11/1984 Goshorn ..... 91/429 X

*Primary Examiner*—Alan Cohan

*Attorney, Agent, or Firm*—Christie, Parker & Hale

[57] ABSTRACT

A pneumatic pressure regulating system controls a choke having a hydraulic operator actuator for selectively opening or closing the choke to control pressure in a well casing. The system applies periodic pulses of pneumatic pressure for opening an output valve in one direction when the actual casing pressure is greater than a selected control pressure for opening the choke, and applies periodic pulses of pneumatic pressure for opening the output valve in another direction when casing pressure is less than the set pressure for closing the choke. The interval between sucessive pulses is adjusted to be long enough for the pressure in the casing to equilibrate before the next pulse occurs.

17 Claims, 1 Drawing Figure

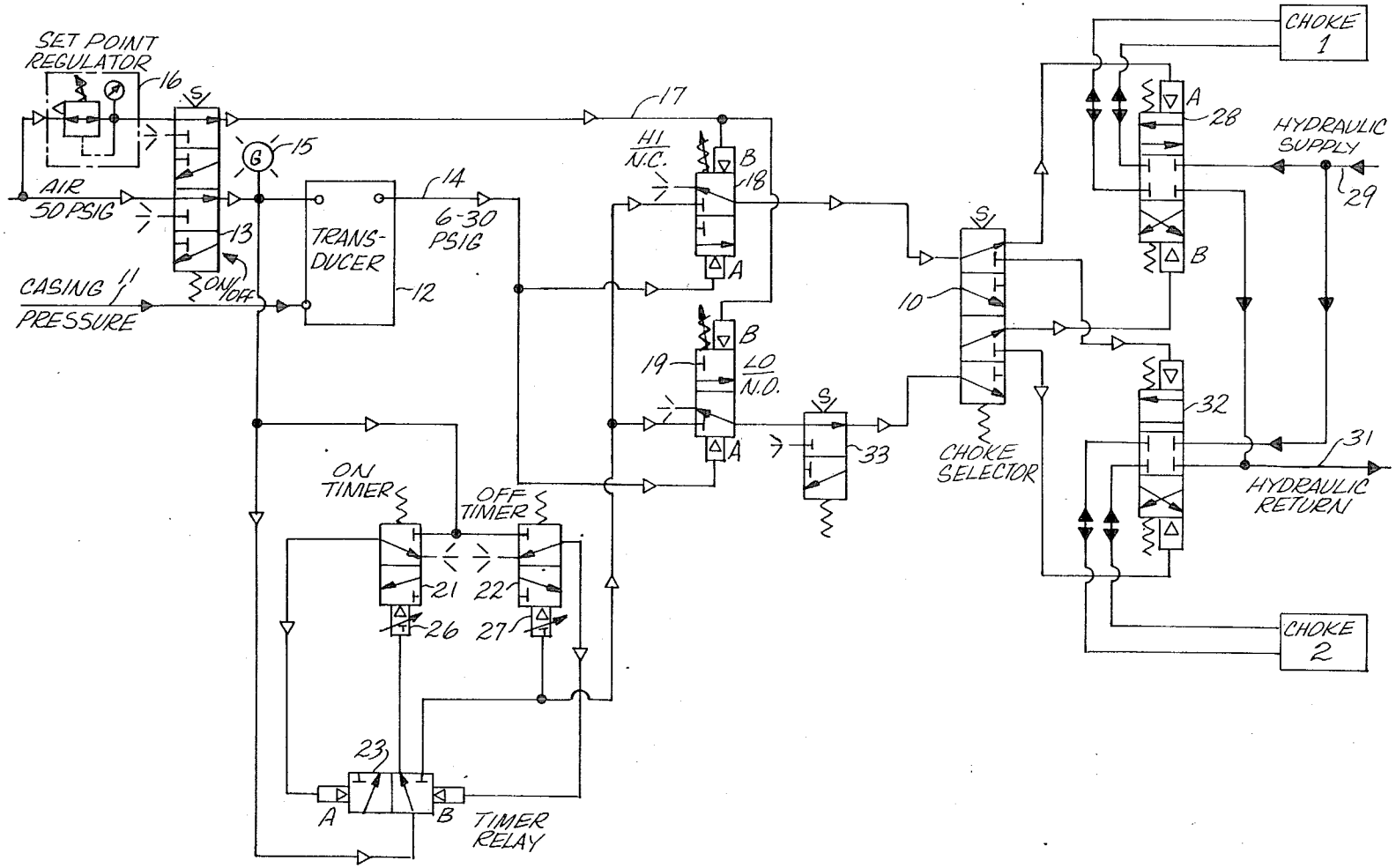
CHOKE 1
HYDRAULIC SUPPLY
29
28
A
B
31
HYDRAULIC RETURN
32
CHOKE 2
S1
10
CHOKE SELECTOR
33
S1
B
18
A
HI N.C.
17
B
20 N.O.
A
19
OFF TIMER
22
27
21
26
ON TIMER
TIMER RELAY
B
23
A
14
6-30 PSIG
12
TRANS-DUCER
15
13
ON/OFF
S1
16
SET POINT REGULATOR
AIR 50 PSIG
11
CASING PRESSURE

PNEUMATIC WELL CASING PRESSURE REGULATING SYSTEM

FIELD OF THE INVENTION

This invention relates to an all pneumatic system for maintaining pressure in a desired range in a well bore during drilling.

BACKGROUND OF THE INVENTION

As an oil well or the like is being drilled, drilling mud is pumped down the drill string to the rock bit that is drilling the well. The drilling fluid such as high density mud exists the drill string at the rock bit and flows to the ground surface in the annulus between the drill string and the bore hole or casing within the bore hole. At the ground surface the drilling mud from the annulus is passed through a high pressure choke or valve, through which a large pressure drop occurs. This maintains a high pressure in the well bore for mud flow control and control of the well.

It is often important to maintain a selected pressure of the drilling mud at the ground surface so that, in combination with the hydrostatic head in the well bore, a desired pressure is maintained at the drill bit. The pressure desired in a given situation depends on the drilling parameters and the rock formations being drilled. A selected minimum pressure is desired for control of the well and to assure proper drilling. A selected maximum pressure is desired for safety reasons and to prevent damage to subterranean rock formations. During drilling various conditions may cause an upward "kick" in pressure and it is desirable to relieve that pressure promptly and in a controlled manner.

For example, pressure may increase in the event a particle of the formation being drilled lodges in the choke and obstructs discharge of drilling fluid. In such a situation it is desirable to open the choke until the particle is dislodged and then close the choke to bring pressure back into the desired range.

It is customary to measure the pressure of the drilling mud being pumped into the drill string and use that pressure as indicative of the desired bottom hole pressure. Control of pressure is obtained by changing the opening of the choke. There is a time lag between a change in choke position and the pressure at the inlet to the drill string. This time lag is in the order of one second per thousand feet of hydraulic line. Thus, for example, if a well is 5000 feet deep, it takes about ten seconds for each change in choke position to be reflected in the pressure at the mud inlet.

Any system for controlling pressure in such a situation needs to gradually change choke position so that overcontrol is minimized and "hunting" of the pressure for the desired range is avoided.

The chokes used on wells are often hydraulically controlled. The choke may, for example, be a needle valve with a rotatable stem. A hydraulic actuator is connected to the stem for rotating it. Hydraulic fluid flow can be used for either opening or closing the valve as required.

It is required in many drilling situations, particularly on offshore platforms and the like, to employ systems that are explosion proof; that is, systems that do not have ignition sources that may trigger a fire or explosion at the drilling site. Electrical systems used in such situations must be provided with explosion-proof housings at considerable expense. For example, an explosion-proof housing for a typical system mounted in a conventional electronics rack may add $3000 to the cost of the system.

It can therefore be highly desirable to provide an all pneumatic system that does not require special provisions to make it explosion proof. Such systems should be reliable, versatile, economical, adjustable, safe, and simple.

BRIEF SUMMARY OF THE INVENTION

There is, therefore, provided in practice of this invention a pneumatic well casing pressure regulating system for selectively opening or closing a choke having a fluid operated actuator. A pneumatically operated valve has one actuator for applying hydraulic fluid or the like for opening the choke and a second actuator for applying fluid for closing the choke. A free running pneumatic timer generates periodic pulses of pneumatic pressure. A pneumatic signal indicative of actual casing pressure is compared with a pneumatic control signal indicative of a desired casing pressure, and the comparator applies such pressure pulses to the first operator for opening the choke when the actual casing pressure signal is greater than the control pressure signal. Alternatively, it applies such pressure pulses to the second operator for closing the choke when the actual casing pressure signal is less than the control pressure signal. Preferably, the free running timer is adjustable to provide pressure pulses of controlled duration and a controlled interval between successive pulses.

BRIEF DESCRIPTION OF THE DRAWINGS

These and other features and advantages of the present invention will be appreciated as the same becomes better understood by reference to the following detailed description when considered in connection with the accompanying drawing which is a pneumatic circuit diagram of a pressure control system employing conventional graphic symbols for fluid power diagrams as specified in American National Standard/ANS Y32.10.

DETAILED DESCRIPTION

The pneumatic control system provided in practice of this invention operates a conventional choke with a hydraulic actuator. These components are indicated schematically in the drawing by a single box labelled "Choke 1". The drawing also illustrates a second choke and actuator labelled "Choke 2", since in most applications on wells a pair of chokes are used so that one can be in use while the other is being repaired or replaced. A manually operated choke selector valve 10 permits the driller to connect the control system to either of the two chokes as desired.

The mud pressure in the casing is applied by a line 11 to a conventional pressure transducer 12. Pneumatic pressure at, for example, 50 psig, is also directed to the transducer by way of simple on/off valve 13 used for activating the system. A signal device 15 indicates when the system is on. There is ample compressed air at a drilling site and such air can be used in the control system without special conditioning. The transducer 12 converts the mud pressure, which may range from 0 to 10,000 psig, to a pneumatic signal on an output line 14. In an exemplary embodiment the pressure of the signal indicative of actual casing pressure may range from 6 to 30 psig.

The supply air pressure is also connected to a set point regulator 16 which can be adjusted to provide a pneumatic control signal 17 indicative of the desired casing pressure. The control signal is in the same range as the signal indicative of actual casing pressure, e.g., 6 to 30 psig. In the illustrated embodiment the set point regulator is upstream from the system on/off valve 13, however, if desired it can be readily accommodated downstream from the valve.

The control signal 17 is connected to the B-operator of a normally closed high level comparator valve 18. The control signal is also applied to the B-operator of a normally open low level comparator valve 19. The transducer output 14 having the signal indicative of actual casing pressure is connected to the A-operator of each of the comparator valves 18 and 19.

The high level comparator valve 18 is adjustably spring biased to a closed position. When the actual casing pressure signal on the A-operator of the high level comparator valve is greater than the control signal, the comparator valve opens and remains open as long as the actual casing pressure signal is greater than the control signal. As will become apparent, opening of the high level comparator valve serves to open the choke.

The low level comparator valve 19 is adjustably spring biased toward the open position. When the actual casing pressure signal is greater than the control signal, the valve is kept closed. If the actual casing pressure signal decreases below the desired control pressure signal, the low level comparator valve opens, resulting in closing of the choke.

The spring bias that maintains the high level comparator valve in its closed position is adjustable so that the magnitude of the difference in pressure that causes the valve to open can be selected. By making a similar adjustment on the low level comparator valve, the "dead band" of the control system can be set. Thus, if the spring biases are adjusted so that it takes a one psi pressure difference to change a comparator valve, the actual casing pressure can vary between much broader limits than when the comparator valves are adjusted to change when the pressure difference is only one-fourth psi, for example.

The inlet to each of the comparator valves 18 and 19 is connected to an adjustable free running pneumatic timer circuit for providing periodic pulses of pneumatic pressure. The free running pneumatic timer is illustrated toward the lower left of the drawing and comprises an ON timer valve 21, an OFF timer valve 22 and a bistable timer relay valve 23.

The ON timer valve and OFF timer valve are identical. Each timer valve is a spring biased pneumatically operated three-way valve. Supply air from the on/off valve 13 is applied to an inlet of each timer valve. The other "inlet" of each timer is a vent. The timer valves are spring biased so that they are normally closed, with the outlet connected to the vent. Each timer valve has an adjustable timed pneumatic operator 26, 27. When pneumatic pressure is applied to one of the timed operators, a timer is started. At the end of a selected interval the operator causes the timer valve to switch to its open position. When the valve has been opened for a short interval (typically a fraction of a second) it again closes.

The outlet of the ON timer valve 21 is connected to the A-operator of the timer relay valve 23. Similarly the outlet of the OFF timer valve 22 is connected to the B-operator of the timer relay valve. Supply air from the on/off valve B is connected to the inlet of the timer relay valve. One outlet of the timer relay valve is connected to the operator 26 of the ON timer valve and the other outlet is connected to the operator 27 of the OFF timer valve. One outlet, in this case the one to the OFF timer operator, is connected to the inlets to the comparator valves 18 and 19 to provide periodic pressure pulses. It will become apparent that periodic pressure pulses are available at either outlet from the timer relay valve because of the symmetry of the free running pneumatic timer system.

Assuming that the timer system is in the state illustrated when the on/off valve 13 is opened, air pressure is applied by way of the timer relay valve to the operator 26 of the on timer valve. This starts the timer and after its set interval, the ON timer valve opens. Opening of the ON timer valve applies line air pressure to the A-operator of the timer relay valve. This causes the timer relay valve to shuttle to its other position.

In this second position of the relay valve, pressure is shut off from the operator of the ON timer valve and in a fraction of a second the ON timer valve again closes. Air pressure is instead applied to the operator 27 of the OFF timer valve and to the inlets of the comparator valves. This starts the timed cycle of the OFF timer and at the end of its preset interval, the OFF timer valve opens. Opening of the OFF timer valve appies pneumatic pressure to the B-operator of the timer relay shifting it back towards its initial state. (The A-operator of the timer relay valve is vented through the ON timer valve which is then in its closed position to permit free shuttling of the relay valve.) Shuttling the timer relay valve back to its initial position cuts off air pressure to the OFF timer operator and to the inlets of the comparator valves. Pressure in the connecting lines drops off quickly through the OFF timer operator and the OFF timer valve reverts to its closed position.

The shuttling of the timer relay valve to its initial state also applies pneumatic pressure to the ON timer operator 26 to restart the cycle. The free running timer system continues to repeat the cycle as long as line pressure is applied, thereby providing periodic pneumatic pressure pulses to the comparator inlets.

The length of the pressure pulse in the illustrated embodiment is determined by the time setting of the OFF timer operator. In effect the ON timer valve turns on the pulse and the OFF timer valve turns off the pulse. Similarly, the interval between pulses in determined by the time period set at the ON timer operator. In an exemplary embodiment for a 5,000 foot deep well, the OFF timer operated might be set at one or two seconds so that a choke actuator is operator for one or two seconds, and the interval between pulses set on the ON timer operator may be twelve seconds to assure that pressure equilibrates before the next pulse.

When the actual casing pressure is in the desired range, both comparator valves are closed and the choke remains unchanged. If, for example, the actual casing pressure is above the set point, the high level comparator valve 18 opens and the pressure pulses applied thereto are conveyed to the A-operator of a three position output valve 28 by way of the choke selector valve 10. The three position valve is spring biased so that it is normally closed. When pneumatic pressure is applied to the A-operator of the output valve, it shifts to a position where hydraulic pressure from a hydraulic supply line 29 is applied to the actuator of Choke 1 while the other side of the actuator is connected to the hydraulic return line 31. The B-operator of the three position valve 28 is vented through the low level comparator valve 19 so that shifting of the three position valve by the A-operator is not inhibited. When hydraulic fluid is provided in this direction to the choke actuator, it causes the choke to move toward its open position.

As soon as the pressure pulse on the A-operator of the three position valve ends by reason of cycling of the free running timer system, air pressure drains off through the OFF timer operator 27 and the three position valve returns to its normally closed position. This cuts off the flow of hydraulic fluid and stops movement of the choke actuator until the next pulse is received.

Conversely, if the actual casing pressure signal is less than the control pressure signal, the low level comparator valve 19 opens. This applies the pressure pulses from the free running timer system to the B-operator of the three position valve output 28. This shifts the three position valve to a position where hydraulic fluid is applied to the choke actuator in a direction that reverses the actuator direction and tends to close the choke. Closing continues step by step as long as pulses continue to be applied to the B-operator of the three position valve by way of the low level comparator valve.

It should be recognized that a typical hydraulic actuator for a choke is a hydraulic motor that runs while the pressure is applied and stops when pressure is relieved. When hydraulic fluid is directed through the actuator, it runs in one direction. Its direction is reversed when the direction of application of hydraulic fluid is reversed.

Thus, the pressure regulating system has a continual source of periodic pulses of pneumatic pressure. When casing pressure is too high, the pulses open the three position valve every time a pulse occurs. This applies pulses of hydraulic pressure to the actuator and opens the choke in a series of small steps, with sufficient time between steps for pressure to equilibrate. Conversely, when casing pressure is too low, the pneumatic pressure pulses are transformed into hydraulic pulses applied for closing the choke by reason of periodically shifting the three position valve to its other position. The comparator valves determine where the pneumatic pressure pulses are directed in response to casing pressure differences.

A second three position output valve 32 is connected to the actuator of Choke 2 in exactly the same manner as the first three position valve 28 is connected to Choke 1. When the choke selector valve 10 is moved to its other position, pulses may be applied to the second three position valve for adjusting Choke 2 instead of Choke 1.

A manually operated mode selector valve 33 is connected in the line between the low level comparator valve 19 and the choke selector valve 10. In the illustrated position of the mode selector valve, the system operates as described for regulating casing pressure in a desired range. There are circumstances where the only desired control is a limit on the maximum pressure of the fluid in the well and the mode selector valve can be switched to provide that mode of operation. When switched, the B-operator of the three position hydraulic valve is vented and there is no low level control. In the event the pressure in a well exceeds a limit set by the regulator 16, the three position hydraulic valve is actuated as hereinabove described to open the choke and relieve the pressure.

Various modifications and variations can be made in the pressure regulating system described and illustrated. For example, the pressure regulating system could control pressure downstream from a choke, in which case opening of the high level comparator valve would close the choke instead of opening it. Equivalent components can be substituted for some of the components in the system herein described and illustrated. For example, separate two position valve could be used instead of a three position valve for transforming the pneumatic pressure pulses to hydraulic pulses. It is therefore to be understood that within the scope of the appended claims the invention may be practiced otherwise than as specifically described.

What is claimed is:

1. A pneumatic well casing pressure regulating system comprising:

a hydraulically actuated choke for relieving well casing pressure;

a continually running source of pneumatic pressure pulses;

first means for applying pulses of hydraulic fluid corresponding to the pneumatic pressure pulses to the choke for opening the choke one step for each pulse of hydraulic fluid when actual casing pressure is higher than a desired casing pressure; and second means for applying pulses of hydraulic fluid corresponding to the pneumatic pressure pulses to the choke for closing the choke one step for each pulse of hydraulic fluid when actual casing pressure is less than a desired casing pressure.

2. A pneumatic well casing pressure regulating system as recited in claim 1 wherein the interval between successive pneumatic pressure pulses is adjustable.

3. A pneumatic well casing pressure regulating system as recited in claim 2 wherein the length of the pneumatic pressure pulses is adjustable.

4. A pneumatic well casing pressure regulating system as recited in claim 1 wherein the length of the pneumatic pressure pulses is adjustable.

5. A pneumatic well casing pressure regulating system as recited in claim 1 wherein the first means for applying pulses of hydraulic fluid comprises a pneumatically operating comparator valve connected to a pneumatic signal indicative of actual casing pressure and a pneumatic signal indicative of a desired casing pressure for opening the comparator valve when casing pressure is greater than a maximum desired pressure and closing the comparator valve when the casing pressure is less than the desired maximum desired pressure, the pneumatic pressure pulses being applied to the inlet of the comparator valve.

6. A pneumatic well casing pressure regulating system as recited in claim 5 wherein the second means for applying pulses of hydraulic fluid comprises a second pneumatically operated comparator valve connected to the pneumatic signal indicative of actual casing pressure and a pneumatic signal indicative of a desired casing pressure for opening the second comparator valve when casing pressure is less than a minimum desired pressure and closing the comparator valve when the casing pressure is greater than the minimum desired pressure, the pneumatic pressure pulses also being applied to the inlet of the second comparator valve.

7. A pneumatic well casing pressure regulating system as recited in claim 6 wherein the first and second means for applying pulses of hydraulic fluid comprise a pneumatically operated hydraulic valve for applying hydraulic fluid to the choke actuator, the output of the first comparator valve being connected to the hydraulic valve for opening the valve in one direction, and the output of the second comparator valve being connected to the hydraulic valve for opening the valve in the other direction.

8. A pneumatic well casing pressure regulating system as recited in claim 1 wherein the continually running source of pneumatic pressure pulses comprises:

a normally closed ON valve;

ON timer means for temporarily opening the ON valve at the end of the first selected time interval;

a normally closed OFF valve;

OFF timer means for temporarily opening the OFF valve at the end of a second selected time interval;

a bistable relay valve;

means for connecting pneumatic pressure to the inlets of the ON valve, the OFF valve and the relay valve;

means for connecting the outlet of the OFF valve to a first operator of the relay valve for shifting the relay valve to a first state;

means for connecting the outlet of the ON valve to a second operator of the relay valve for shifting the relay valve to a second state;

a first outlet from the relay valve connected to the OFF timer means, the first state of the relay valve connecting the inlet and the first outlet for operating the OFF timer means; and a second outlet from the relay valve connected to the ON timer means, the second state of the relay valve connecting the inlet and the second outlet for operating the ON timer means so that at least one of the outlets of the relay valve provides pulses of pneumatic pressure.

9. A pneumatic well casing pressure regulating system comprising:

a choke having a fluid operated actuator for selectively opening or closing the choke;

pneumatically operated output valve means having a first operator for actuating the output valve means to apply fluid for opening the choke, and a second operator for actuating the output valve means to apply fluid for closing the choke;

means for generating a pneumatic signal indicative of actual casing pressure;

means for generating a pneumatic control signal indicative of a desired casing pressure;

timer means for generating periodic pulses of pneumatic pressure; and comparator means for applying such pulses of pneumatic pressure to the first operator when the actual casing pressure signal is greater than the control pressure signal for opening the choke one step for each pressure pulse and for applying such pressure pulses to the second operator when the actual casing pressure signal is less than the control pressure signal for closing the choke one step for each pressure pulse.

10. A pneumatic well casing pressure regulating system as recited in claim 9 wherein the comparator means comprises:

a normally closed pressure comparator valve having an inlet connected to the source of pulses of pneumatic pressure and an outlet connected to the first operator;

a normally open pressure comparator valve having an inlet connected to the source of pulses of pneumatic pressure and an outlet connected to the second operator;

means for applying the actual casing pressure signal and the control signal to the normally closed comparator valve for opening the valve when the actual casing pressure signal is greater than the control signal; and means for applying the actual casing pressure signal and the control signal to the normally open comparator valve for keeping the valve closed when the actual casing pressure signal is greater than the control signal.

11. A pneumatic well casing pressure regulating system as recited in claim 10 further comprising means for selectively disconnecting the normally open pressure comparator valve from the output valve means for converting the system to a maximum pressure limited system.

12. A pneumatic well casing pressure regulating system as recited in claim 9 wherein the output valve means comprises a three position normally closed valve having a first open position for directing hydraulic fluid to the choke actuator in one direction, and a second open position for directing hydraulic fluid to the choke actuator in the opposite direction.

13. A pneumatic well casing pressure regulating system as recited in claim 9 wherein the timer means for generating periodic pulses of pneumatic pressure comprises a free running pneumatic timer system comprising:

a normally closed ON valve;

ON timer means for temporarily opening the ON valve at the end of a first selected time interval;

a normally closed OFF valve;

OFF timer means for temporarily opening the OFF valve at the end of a second selected time interval;

a bistable relay valve;

means for connecting pneumatic pressure to the inlets of the ON valve, the OFF valve and the relay valve;

means for connecting the outlet of the OFF valve to a first operator of the relay valve for shifting the relay valve to a first state;

means for connecting the outlet of the ON valve to a second operator of the relay valve for shifting the relay valve to a second state;

a first outlet from the relay valve connected to the OFF timer means, the first state of the relay valve connecting the inlet and the first outlet for operating the OFF timer means; and a second outlet from the relay valve connected to the ON timer means, the second state of the relay valve connecting the inlet and the second outlet for operating the ON timer means so that at least one of the outlets of the relay valve provides pulses of pneumatic pressure.

14. A pneumatic well casing pressure regulating system comprising:

a choke having a fluid operated choke actuator;

pneumatically operated, normally closed output valve means for selectively applying fluid pressure to the actuator for selectively opening or closing the choke;

a normally closed high level pneumatic comparator valve having an outlet connected to an operator of the output valve means for opening the output valve means to apply fluid to the choke actuator for opening the choke;

a normally open low level pneumatic comparator valve having an outlet connected to an operator of the output valve means for opening the output vavle means to apply fluid to the choke actuator for closing the choke;

a pneumatic set point regulator having its outlet connected to an operator of each of the comparator valves;

transducer means for converting casing pressure to a pneumatic signal proportional to casing pressure, and having an outlet connected to an operator of each of the comparator valves; and a free running pneumatic timer system having a variable ON cycle and a variable OFF cycle for applying timed pulses of pneumatic pressure to the inlet of each of the comparator valves so that when such a comparator valve is open, pulses of pneumatic pressure are applied to a selected operator of the output valve means.

15. A pneumatic well casing pressure regulating system as recited in claim 14 wherein the timer system comprises:

a normally closed pneumatic ON timer valve having an inlet connected to a source of pneumatic pressure;

a normally closed pneumatic OFF timer valve having an inlet connected to a source of pneumatic pressure;

a bistable timer relay valve having an inlet connected to a source of pneumatic pressure, a first outlet connected to the operator of the ON timer valve, a second outlet connected to the OFF timer valve, and to the inlet of each of the comparator valves;

the outlets of the ON timer valve and OFF timer valve being connected to the timer relay vavle for alternately shifting the timer relay between its two stable positions.

16. A pneumatic well casing pressure regulating system comprising:

a choke connected to a well casing and having a hydraulic fluid operated actuator for selectively opening or closing the choke;

a pneumatically operated, normally closed, three position output valve having a first pneumatic operator for actuating the output valve to a first open position for directing hydraulic fluid to the choke actuator in one direction for opening the choke, and a second pneumatic operator for actuating the output valve to a second open position for directing hydraulic fluid to the choke actuator in the opposite direction for closing the choke;

transducer means for converting actual casing pressure to a pneumatic signal indicative of actual casing pressure;

regulator means for generating a pneumatic control signal indicative of a desired casing pressure;

a free running pneumatic timer system for generating periodic pulses of pneumatic pressure comprising:

a normally closed ON valve;

ON timer means for temporarily opening the ON valve at the end of a first selected time interval;

a normally closed OFF valve;

OFF timer means for temporarily opening the OFF valve at the end of a second selected time interval;

a bistable relay valve;

means for connecting pneumatic pressure to the inlets of the ON valve, the OFF valve and the relay valve;

means for connecting the outlet of the OFF valve to a first operator of the relay valve for shifting the relay valve to a second state;

a first outlet from the relay valve connected to the OFF timer means, the first state of the relay valve connecting the inlet and the first outlet for operating the OFF timer means; and a second outlet from the relay valve connected to the ON timer means, the second state of the relay valve connecting the inlet and the second outlet for operating the ON timer means so that at least one of the outlets of the relay valve provides periodic pulse of pneumatic pressure;

a normally closed pressure comparator valve having an inlet connected to the source of pulses of pneumatic pressure and an outlet connected to the first operator;

a normally open pressure comparator valve having an inlet connected to the source of pulses of pneumatic pressure and an outlet connected to the second operator;

means for applying the actual casing pressure signal and the control signal to the normally closed comparator valve for opening the valve when the actual casing pressure signal is greater than the control signal; and means for applying the actual casing pressure signal and the control signal to the normally open comparator valve for keeping the valve closed when the actual casing pressure signal is gerater than the control signal.

17. A pneumatic well casing pressure regulating system as recited in claim 16 further comprising means for selectively disconnecting the normally open pressure comparator valve from the output valve means for converting the system to a maximum pressure limiting system.

* * * * *